US009425516B2

(12) United States Patent
Chen et al.

(10) Patent No.: US 9,425,516 B2
(45) Date of Patent: Aug. 23, 2016

(54) COMPACT DUAL BAND GNSS ANTENNA DESIGN

(71) Applicant: The Ohio State University, Columbus, OH (US)

(72) Inventors: Chi-Chih Chen, Dublin, OH (US); Ming Chen, Columbus, OH (US); Chia-wei Liu, Fremont, CA (US)

( * ) Notice: Subject to any disclaimer, the term of this patent is extended or adjusted under 35 U.S.C. 154(b) by 439 days.

(21) Appl. No.: 13/936,955

(22) Filed: Jul. 8, 2013

(65) Prior Publication Data

US 2014/0210678 A1 Jul. 31, 2014

Related U.S. Application Data

(60) Provisional application No. 61/668,633, filed on Jul. 6, 2012.

(51) Int. Cl.

| | |
|---|---|
| ***H01Q 21/00*** | (2006.01) |
| ***H01Q 21/30*** | (2006.01) |
| ***H01Q 9/04*** | (2006.01) |
| ***H01Q 13/10*** | (2006.01) |
| ***H01Q 5/364*** | (2015.01) |

(52) U.S. Cl.

CPC ..... *H01Q 21/30* (2013.01); *H01Q 5/364* (2015.01); *H01Q 9/0435* (2013.01); *H01Q 9/0457* (2013.01); *H01Q 13/10* (2013.01)

(58) Field of Classification Search

USPC ..... 343/725, 700 MS, 702

See application file for complete search history.

(56) References Cited

U.S. PATENT DOCUMENTS

| | | | | |
|---|---|---|---|---|
| 3,308,463 | A | 3/1967 | Emerson | |
| 3,854,137 | A | 12/1974 | Kohler | |
| 3,900,879 | A | 8/1975 | Lewinter | |
| 3,911,357 | A | 10/1975 | Adam | |
| 3,918,054 | A | 11/1975 | Collins | |
| 3,975,738 | A | 8/1976 | Pelton et al. | |
| 4,276,509 | A | 6/1981 | Bryant et al. | |
| 4,287,520 | A | 9/1981 | Van Vliet et al. | |
| 4,395,677 | A | 7/1983 | Petersdorf | |
| 4,475,108 | A | 10/1984 | Moser | |
| 4,584,523 | A | 4/1986 | Elabd | |
| 4,673,944 | A | 6/1987 | Graves | |
| 4,712,057 | A | 12/1987 | Pau | |
| 4,761,654 | A * | 8/1988 | Zaghloul ..... | H01Q 9/0414 343/700 MS |
| 4,764,773 | A | 8/1988 | Larsen et al. | |

(Continued)

FOREIGN PATENT DOCUMENTS

| | | | |
|---|---|---|---|
| CA | 2416597 | A1 | 7/2003 |
| CA | 2529463 | A1 | 4/2006 |

(Continued)

OTHER PUBLICATIONS

Burnside, W.D. et al, An Ultra-Wide Bandwidth, Tapered Chamber Feed, 1996 AMTA Symposium, Seattle, WA, Oct. 1996, pp. 103-108.

(Continued)

*Primary Examiner* — Hoang V Nguyen
*Assistant Examiner* — Hai Tran
(74) *Attorney, Agent, or Firm* — Standley Law Group LLP

(57) ABSTRACT

An antenna structure comprising a dielectric substrate layer and a patch layer laminated on top of the dielectric substrate layer, wherein the antenna structure is adapted to provide dual band coverage by combining a patch mode and a slot mode configuration.

22 Claims, 9 Drawing Sheets

(56) References Cited

U.S. PATENT DOCUMENTS 4,813,198 A 3/1989 Johnston et al.
4,835,542 A 5/1989 Sikina, Jr.
5,012,255 A 4/1991 Becker
5,014,346 A 5/1991 Phillips et al.
5,039,949 A 8/1991 Hemming et al.
5,039,992 A 8/1991 Lenormand et al.
5,043,738 A 8/1991 Shapiro et al.
5,089,700 A 2/1992 Sapia et al.
5,138,330 A 8/1992 Lindenmeier et al.
5,139,850 A 8/1992 Clarke et al.
5,147,694 A 9/1992 Clarke
5,266,960 A 11/1993 Lindenmeier et al.
5,293,177 A 3/1994 Sakurai et al.
5,337,016 A 8/1994 Wozniak et al.
5,355,144 A 10/1994 Walton et al.
5,436,872 A 7/1995 Gilmour et al.
5,459,760 A 10/1995 Watanabe
5,548,297 A * 8/1996 Arai ..... H01Q 5/40 343/700 MS
5,577,269 A 11/1996 Ludewig
5,598,163 A 1/1997 Cornic et al.
5,620,799 A 4/1997 Sauer
5,621,413 A 4/1997 Lempkowski et al.
5,638,281 A 6/1997 Wang
5,673,050 A 9/1997 Moussally et al.
5,739,790 A 4/1998 Green, Jr.
5,756,991 A 5/1998 Risinger et al.
5,757,194 A 5/1998 Yun
5,768,131 A 6/1998 Lissel et al.
5,812,098 A 9/1998 Harris et al.
5,821,904 A 10/1998 Kakizawa et al.
5,834,661 A 11/1998 Nonaka et al.
5,853,889 A 12/1998 Joshi et al.
5,864,319 A 1/1999 Paulus
5,867,129 A 2/1999 Sauer
5,874,917 A 2/1999 Desodt et al.
5,900,833 A 5/1999 Sunlin et al.
5,917,458 A 6/1999 Ho et al.
5,923,284 A 7/1999 Artis et al.
5,923,299 A 7/1999 Brown et al.
5,945,957 A 8/1999 Kakizawa
5,952,954 A 9/1999 Beckner
5,995,058 A * 11/1999 Legay ..... H01Q 1/521 343/700 MS
5,999,134 A 12/1999 Dishart et al.
5,999,135 A 12/1999 Nozaki et al.
6,002,357 A 12/1999 Redfern et al.
6,081,237 A 6/2000 Sato et al.
6,085,151 A 7/2000 Farmer et al.
6,087,996 A 7/2000 Dery
RE36,819 E 8/2000 Gellner et al.
6,198,427 B1 3/2001 Aker et al.
6,208,303 B1 3/2001 Tachihara et al.
6,211,812 B1 4/2001 Chiles et al.
6,229,493 B1 5/2001 Iijima
6,268,832 B1 7/2001 Twort et al.
6,292,129 B1 9/2001 Matsugatani et al.
6,320,558 B1 11/2001 Walton
6,356,236 B1 3/2002 Maeuser et al.
6,377,221 B1 4/2002 Lindenmeier et al.
6,437,748 B1 8/2002 Burnside et al.
6,452,560 B2 9/2002 Kunysz
6,483,468 B2 11/2002 Walton
6,551,715 B1 4/2003 Seto et al.
6,614,922 B1 9/2003 Walton
6,639,558 B2 10/2003 Kellerman et al.
6,667,721 B1 12/2003 Simonds
6,693,597 B2 2/2004 Walton et al.
6,765,542 B2 7/2004 McCarthy et al.
6,784,826 B2 8/2004 Kane et al.
6,806,826 B2 10/2004 Walton et al.
6,836,247 B2 12/2004 Soutiaguine et al.
6,860,081 B2 3/2005 Walton et al.
6,864,834 B2 3/2005 Walton
6,930,639 B2 8/2005 Bauregger et al.
7,027,004 B2 4/2006 Haunberger et al.
7,116,278 B2 10/2006 Marsan et al.
7,148,848 B2 12/2006 Colburn et al.
7,158,086 B2 1/2007 Inatsugu et al.
7,170,461 B2 1/2007 Parsche
7,183,981 B1 2/2007 Chao
7,183,982 B2 * 2/2007 Kadambi ..... H01Q 1/243 343/700 MS
7,187,335 B2 3/2007 Vincent
7,193,566 B2 3/2007 Chen et al.
7,215,288 B2 5/2007 Park et al.
7,221,326 B2 5/2007 Ida et al.
7,224,280 B2 5/2007 Ferguson et al.
7,248,223 B2 7/2007 Habib et al.
7,253,786 B1 8/2007 Logozzo
7,262,739 B2 8/2007 Chen
7,265,727 B2 9/2007 Connor
7,268,730 B2 9/2007 Park et al.
7,277,059 B2 10/2007 Lin et al.
7,295,154 B2 11/2007 Walton et al.
7,298,346 B2 11/2007 Heyde et al.
7,304,613 B2 12/2007 Aron et al.
7,327,324 B2 2/2008 Wang et al.
7,327,327 B2 2/2008 Wong et al.
7,339,542 B2 3/2008 Lalezari
7,346,399 B2 3/2008 Berube
7,348,703 B2 3/2008 Bojiuc
7,352,336 B1 4/2008 Lier et al.
7,358,900 B2 4/2008 Song et al.
7,358,911 B2 4/2008 Vincent
7,375,687 B2 5/2008 Ke et al.
7,375,700 B2 5/2008 Hwang et al.
7,385,561 B2 6/2008 Krupa
7,391,374 B2 6/2008 Inatsugu et al.
7,403,164 B2 7/2008 Sanz et al.
7,405,701 B2 7/2008 Ozkar
7,411,556 B2 8/2008 Sanz et al.
7,417,588 B2 8/2008 Castany et al.
7,423,592 B2 9/2008 Pros et al.
7,433,725 B2 10/2008 Lin et al.
7,436,360 B2 10/2008 Chen et al.
7,446,708 B1 11/2008 Nguyen et al.
7,446,724 B2 11/2008 Shimoda
7,460,069 B2 12/2008 Park et al.
7,477,200 B2 1/2009 Parsche
7,482,979 B2 1/2009 Chiang
7,495,616 B2 2/2009 Tang et al.
7,522,110 B2 4/2009 Wu
7,535,423 B2 5/2009 Lin et al.
7,542,002 B1 6/2009 Andersson
7,554,493 B1 6/2009 Rahman
7,554,506 B2 6/2009 Chung et al.
D595,700 S 7/2009 Cook et al.
7,583,230 B2 9/2009 Vincent
7,605,759 B2 10/2009 Moon et al.
7,619,564 B2 11/2009 Chang et al.
7,619,582 B2 11/2009 Chung et al.
7,642,987 B2 1/2010 Newman
8,125,398 B1 2/2012 Paulsen
8,135,354 B2 3/2012 Duron et al.
2001/0015698 A1 8/2001 Tokoro
2002/0122009 A1 9/2002 Winebrand et al.
2003/0011510 A1 1/2003 Haruta et al.
2003/0112190 A1 6/2003 Baliarda et al.
2009/0219219 A1 * 9/2009 Pintos ..... H01Q 9/0407 343/853
2010/0207830 A1 * 8/2010 Parsche ..... H01Q 9/0435 343/732
2011/0140977 A1 6/2011 Yang et al.
2011/0279339 A1 11/2011 Johnston
2012/0098719 A1 4/2012 Mumbru et al.

FOREIGN PATENT DOCUMENTS

EP 1329740 A2 7/2003
EP 1810054 A2 7/2007
GB 2309829 A 8/1997
JP 2001-526771 T 12/2001
KR 10-0365140 B1 12/2002

(56) References Cited

FOREIGN PATENT DOCUMENTS

| | | | |
|---|---|---|---|
| WO | 03/027707 | A2 | 4/2003 |
| WO | 03/073124 | A1 | 9/2003 |
| WO | 03/092117 | A2 | 11/2003 |
| WO | 03/092117 | A3 | 2/2004 |
| WO | 2004/051869 | A2 | 6/2004 |
| WO | 2004/051870 | A2 | 6/2004 |
| WO | 2004/051869 | A3 | 8/2004 |
| WO | 2005/003810 | A1 | 1/2005 |
| WO | 2004/051870 | A3 | 2/2005 |
| WO | 2006/044911 | A2 | 4/2006 |

OTHER PUBLICATIONS

Chan, L.C. et al., A Characterization of Subsurface Radar Targets, Proceeding of the IEEE, Jul. 1979, pp. 991-1000, 67(7).
Chen, C.-C. et al., Ultrawide-Bandwidth Fully-Polarimetric Ground Penetrating Radar Classification of Subsurface Unexploded Ordnance, Jun. 2001, pp. 1221-1230, 39(6).
Chen, C.-C., Ultrawide Bandwidth Antenna Design, Antenna Engineering Handbook, Chapter 19, 2007, Fourth Edition, pp. 19-1-19-20, McGraw-Hill, New York.
Cosgrove, R.B. et al., Trained Detection of Buried Mines in SAR Images via the Deflection-Optimal Criterion, IEEE Transactions on Geoscience and Remote Sensing, Nov. 2004, pp. 2569-2575, 42(11).
Erkmen, F. et al., Impedance Matched Ferrite Layers as Ground Plane Treatments to Improve Antenna Wide-Band Performance, IEEE Transactions on Antennas and Propagation, Jan. 2009, pp. 263-266, 57(1).
Gau, J.-R. J. et al., Chebyshev Multilevel Absorber Design Concept, IEEE Transactions on Antennas and Propagation, Aug. 1997, pp. 1286-1293, 45(8).
Kim, M.W. et al., Neural Network Based Optimum Radar Target Detection in Non-Gaussian Noise, Proceedings of the International Joint Conference on Neural Networks, Jun. 7-11, 1992, pp. III-654-III-659.
Lai, A.K.Y. et al., A Novel Antenna for Ultra-Wide-Band Applications, IEEE Transactions on Antennas and Propagation, Jul. 1992, pp. 755-760, 40(7).
Lee, J.J., Ultra Wideband Arrays, Antenna Engineering Handbook, Chapter 24, 2007, Fourth Edition, pp. 24-1-24-24, McGraw-Hill, New York.
Lee, K.-H. et al., Modeling and Investigation of a Geometrically Complex UWB GPR Antenna Using FDTD, IEEE Transactions on Antennas and Propagation, Aug. 2004, pp. 1983-1991, 52(8).
Lee, M. M et al., Distributed Lumped Loads and Lossy Transmission Line Model for Wideband Spiral Antenna Miniaturization and Characterization, Oct. 2007, pp. 2671-2678, 55(10).
Nelson, H.H. et al., Multisensor Towed Array Detection System for UXO Detection, IEEE Transactions on Geoscience and Remote Sensing, Jun. 2001, pp. 1139-1145, 39(6).
Pan, W.-Y., Measurement of Lateral Waves Along a Three-Layered Medium, IEEE Transactions on Antennas and Propagation, Feb. 1986, pp. 267-271, AP-34(2).
Peng, X.-F. et al., Compact Dual-Band GPS Microstrip Antenna, Microwave and Optical Technology Letters, Jan. 5, 2005, pp. 58-61, 44(1).
Pozar, D.M. et al, A Dual-Band Circularly Polarized Aperture-Coupled Stacked Microstrip Antenna for Global Positioning Satellite, IEEE Transactions on Antennas and Propagation, Nov. 1997, pp. 1618-1625, 45(11).
Radzevicius, S.J. et al., Near-field dipole radiation dynamics through FDTD modeling, Journal of Applied Geophysics, 2003, pp. 75-91, 52.
Rao, B.R. et al., Triple-Band GPS Trap-Loaded Inverted L Antenna Array, Microwave and Optical Technology Letters, Jul. 5, 2003, pp. 35-37, 38(1).
Samaddar, S.N. et al., Biconical Antennas with Unequal Cone Angles, IEEE Transactions on Antennas and Propagation, Feb. 1998, pp. 181-193, 46(2).
Shavit, R. et al., Laterial Wave Contribution to the Radiation from a Dielectric Half Medium, Jul. 1995, pp. 751-755, 43(7).
Skolnik, M.I., Detection of Radar Signals in Noise, Introduction to Radar Systems, 1980, pp. 375-376, Second Edition, McGraw-Hill Book Company.
Smith, G.S., Directive Properties of Antennas for Transmission into a Material Half-Space, IEEE Transactions on Antennas and Propagation, Mar. 1984, pp. 232-246, AP-32(3).
Su, C.-M. et al., A Dual-Band GPS Microstrip Antenna, Microwave and Optical Technology Letters, May 20, 2002, pp. 238-240, 33(4).
Valle, S. et al., Ground Penetrating Radar Antennas: Theoretical and Experimental Directivity Functions, IEEE Transactions of Geoscience and Remote Sensing, Apr. 2001, pp. 749-758, 39(4).
Wang, Y. et al., Adaptive Imaging for Forward-Looking Ground Penetrating Radar, IEEE Transactions on Aerospace and Electronic Systems, Jul. 2005, pp. 922-936, 41(3).
Web Pages, http://www.owlnet.rice.edu/~elec43 . . . jects96/pictomaniacs/previous.html, Jan. 19, 2000, 3 pages.
Wicks, M.C. et al., Mono-Blade Phase Dispersionless Antenna, United States Statutory Invention Registration No. US H2016 H, Apr. 2, 2002, 9 pages.
Williams, D.A., Millimetre Wave Radars for Automotive Applications, IEEE MTT-S Digest, 1992, pp. 721-724.
Zhao, J. et al, Low-profile ultra-wideband inverted-hat monopole antenna for 50 MHz-2 GHz operation, Electronic Letters, Jan. 29, 2009, pp. 142-144, 45(3).
Zhou, Y. et al., Dual Band Proximity-Fed Stacked Patch Antenna for Tri-Band GPS Applications, IEEE Transactions on Antennas and Propagation, Jan. 2007, pp. 220-223, 55(1).
Chen, C. et al., A Compact Dual-Band GPS Antenna Design, IEEE Antennas and Wireless Propagation Letters, 2013, pp. 245-248, vol. 12.
Kramer, B.A. et al., Size Reduction of a Low-Profile Spiral Antenna Using Inductive and Dielectric Loading, IEEE Antennas and Wireless Propagation Letters, 2008, pp. 22-25, 7.
Zhou, Y. et al., A Novel 1.5"Quadruple Antenna for Tri-Band GPS Applications," IEEE Antennas and Wireless Propagation Letters, 2006, 12 pages, 5.

* cited by examiner

COMPACT DUAL BAND GNSS ANTENNA DESIGN

CROSS-REFERENCE TO RELATED APPLICATIONS

This application claims priority to U.S. Provisional Application No. 61/668,633, filed Jul. 6, 2012, which is hereby incorporated by reference in its entirety.

STATEMENT REGARDING FEDERALLY SPONSORED RESEARCH OR DEVELOPMENT

This invention was made with government support under contract no. FA8650-09-C-1608 awarded by Air Force SBIR Phase II. The government has certain rights in the invention.

BACKGROUND AND SUMMARY OF THE INVENTION

Exemplary embodiments of the present invention relate generally to a novel design for a compact, slot-loaded, proximity fed patch antenna structure. While the description herein describes frequency bands that are employed in global positioning system (GPS) implementations for exemplary calculations, the design may be equally applied to other applications where a compact, dual band antenna is desirable.

Global navigation satellite systems (GNSS) such as GPS have become very commonly used devices. Well known uses include automobile and truck navigation systems and military applications. The rapid growth of GNSS technology also includes a growing list of new applications, some examples of which include: vehicle and package tracking, child monitoring, surveying, construction, sports equipment, workforce management, and farming. Along with the growth of applications, there are a growing number of GNSS systems such as GPS (U.S.), GLONASS (Russia), Galileo (Europe), and Beidou (China). Due to this growth, additional frequency bands are being allocated for GNSS use. As a result, GNSS transmitting and receiving electronics, including antennas, may be required to be configurable for a range of frequency channels. There is also an increasing amount of clustering of GNSS channels within these bands. A direct result of this clustering is the need for advanced coding schemes for the satellite signals used by GPS devices, and these advanced coding schemes frequently require wider bandwidth GNSS transmission and reception systems.

In addition to being able to receive a greater number of GNSS channels and having wider channel bandwidths, many GNSS applications require antennas to be small in size in order to fit into the desired device packaging. For example, GPS currently operates using the L1 (1575 MHz) and L2 (1227 MHz) bands. Most existing commercial small L1/L2 GNSS/GPS antennas have relatively narrow 10 MHz bandwidths that are not adequate for supporting advanced GPS coding schemes. Bowtie dipole and spiral antenna designs have been used to achieve wider bandwidth but such designs are relatively large in size and not suitable for small GPS devices. Because of the increasing number of GNSS frequency bands, requirements for wider bandwidths, and a desire for small physical sizes, there is an unmet need for a dual-band, wide bandwidth, and small in size antenna design.

Disclosed herein is an exemplary antenna structure adapted to provide dual band coverage comprising a dielectric substrate layer and a patch layer configured with slots. An embodiment is also disclosed that further comprises a 90 degree hybrid coupler in electronic communication between the patch layer and the signal source feeding the patch layer. Embodiments of the antenna are adapted to utilize both patch and slot modes to produce wide bandwidth and dual band coverage. An additional embodiment of the invention is comprised of a plurality of antennas, each comprising a dielectric substrate layer, and a patch layer configured with slots. An exemplary embodiment may also include a 90 degree hybrid coupler in electronic communication between the patch layer and the signal source feeding the patch layer.

In addition to the novel features and advantages mentioned above, other benefits will be readily apparent from the following descriptions of the drawings and exemplary embodiments.

DETAILED DESCRIPTION OF EXEMPLARY EMBODIMENT(S)

Exemplary embodiments of the present invention are directed to a compact dual band antenna design. For example, one embodiment of the antenna may be configured to be 25.4 mm in diameter and 11.27 mm in height (i.e., thickness). In one example, the size of the antenna is only about $\lambda/10$ in L2 band. Unlike known designs, exemplary embodiments of the present invention do not require stacked patch configurations and therefore, do not require an internal conducting patch. In an exemplary embodiment, dual band coverage may be achieved by operating the patch mode in L2 band and slot mode in L1 band.

Figure 1A:
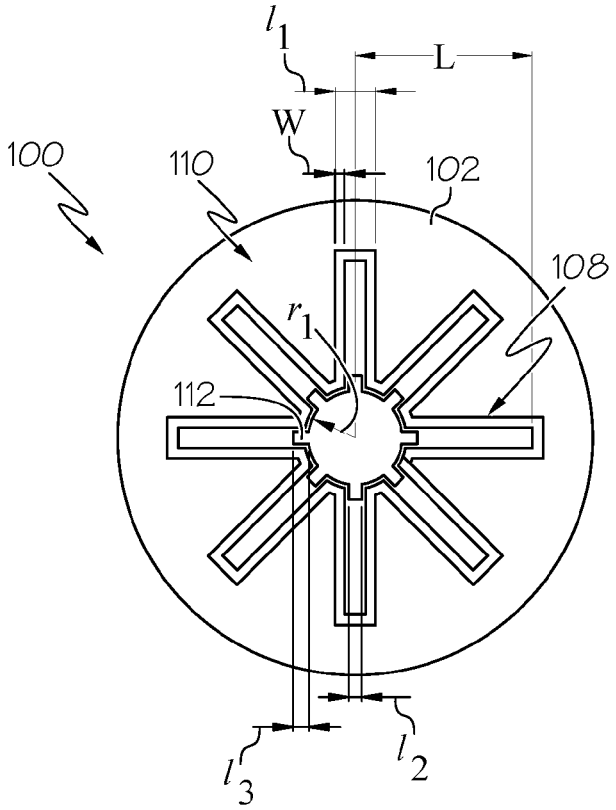
FIG. 1*a* is a top plan view illustration of an exemplary embodiment of an antenna of the invention.
Figure 1B:
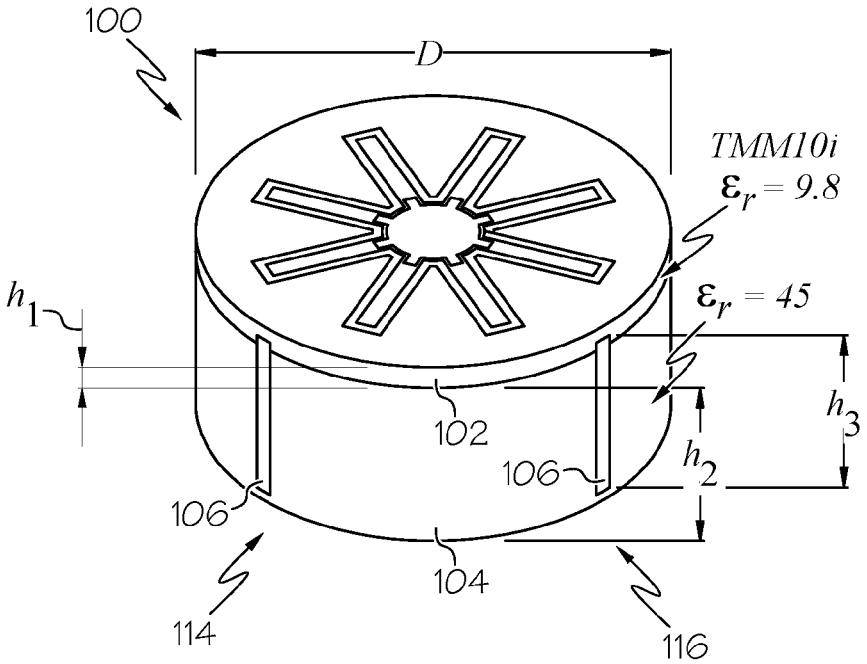
FIG. 1*b* is a perspective view of the embodiment of FIG. 1*a*.

Referring to FIGS. 1*a* and 1*b*, an exemplary embodiment of an antenna 100 according to the present invention may comprise a single slot-loaded conducting patch 102 bonded to a high dielectric ceramic puck 104. In an embodiment of the invention, the slot-loaded patch design may be fabricated using a thermoset microwave laminate such as Rogers TMM10i board ($h_1$=1.27 mm, $\in_r$=9.8, tan $\delta$=0.002) (Rogers Corporation, One Technology Drive, Rogers Conn., USA) or another suitable board material. Such fabrication of the patch and slot structures in the laminated material may be performed using standard printed circuit board (PCB) fabrication processes. In the illustrated embodiment, the high dielectric ceramic puck 104 ($h_2$=10 mm, $\in_r$=45, tan $\delta \approx 0.0001$) may be bonded to the slot-loaded patch using ECCOSTOCK® dielectric paste ($\in_r$=15) (Emerson & Coming Microwave Products, 28 York Avenue, Randolph Mass. USA or other suitable material). Using such a dielectric paste may avoid air gaps and a low-dielectric bonding layer such as formed by common glues. Avoidance of such gaps and a low-dielectric bonding layer may reduce the occurrence of detuning of resonant frequencies as these occurrences may undesirably impact the performance of the resulting antenna structure. Additionally, such an embodiment of the invention may be mechanically superior to known stacked-patch designs where the presence of a middle conducting patch may weaken the bonding between a top and bottom layers of such a design.

Figure 2A:
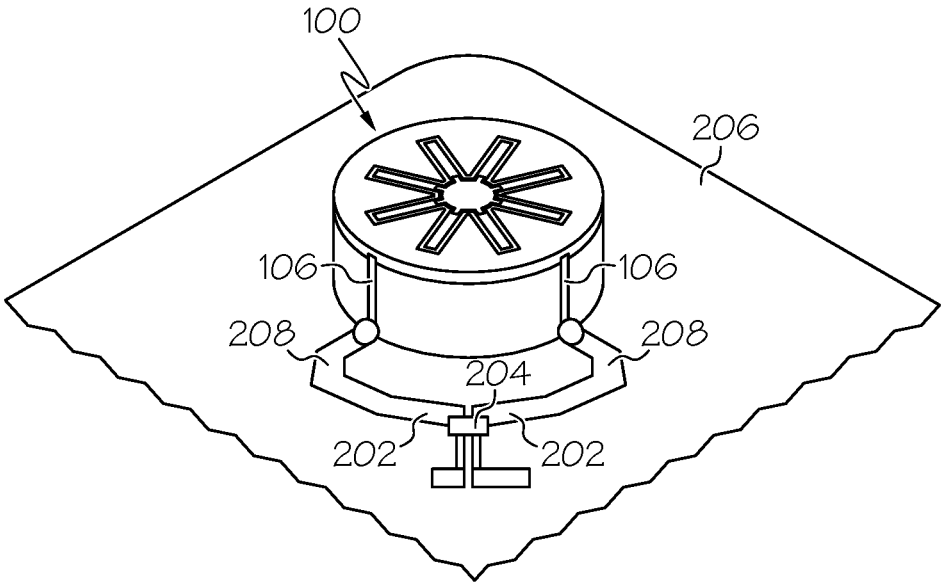
FIG. 2*a* is an illustration of an exemplary embodiment of an antenna of the invention in electronic communication with a 90 degree chip hybrid coupler.
Figure 2B:
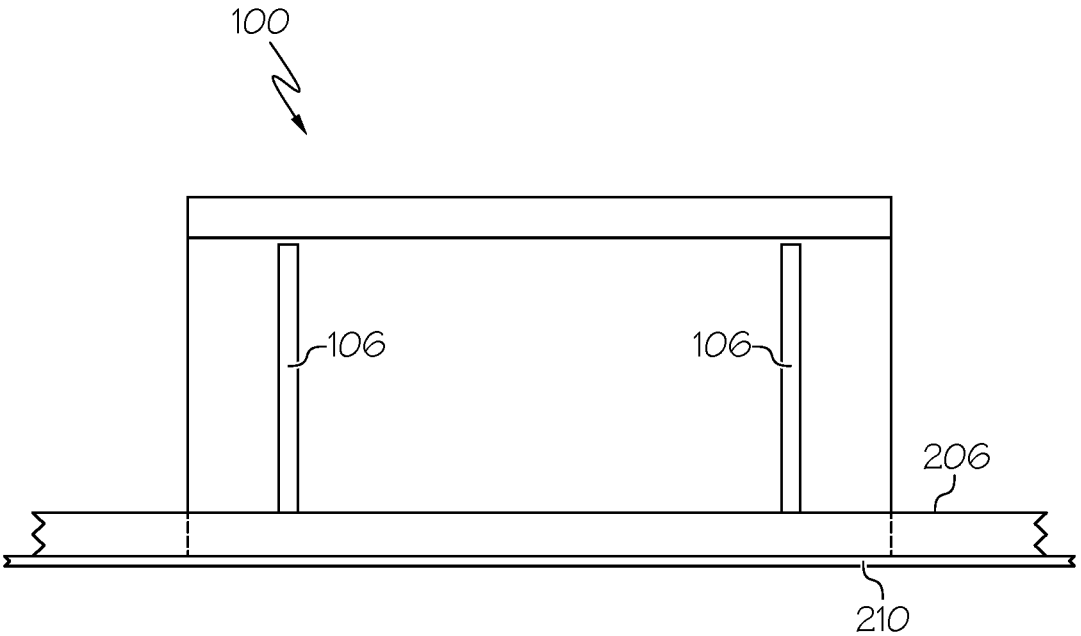
FIG. 2*b* is a side elevation view of the antenna of FIG. 2*a*.

In an exemplary embodiment of the invention, at least two conducting strips may serve as proximity probes (i.e., feeds). As is illustrated in FIG. 1*b*, two conducting strips 106 may be vertically located on the external sides of the antenna structure. In one example embodiment of the antenna, such strips may be formed having a width of 2 mm and a height of 9.8 mm and be located between two adjacent meandering slots at 90 degrees azimuth angle from each other. Such as is illustrated in FIGS. 2*a* and 2*b*, the conducting strips 106 may be connected to the outputs 202 of a 0-90 degree hybrid circuit 204 to obtain right hand circular polarization (RHCP) of the antenna output signal.

Once upper and lower frequency bands are chosen based on the intended application, dielectric constants, the thickness of the upper and lower dielectric layers, the length and width dimensions of the meandering slots, and the length of the inner tuning stubs may be varied to achieve resonant frequencies at those upper and lower bands. An optimal design of the antenna structure illustrated in FIGS. 1*a* and 1*b* may be derived by following three steps after selecting the diameter based on physical characteristics and the two desired resonant frequencies of an application to which the antenna structure will be applied. In the first design step, the dielectric constant and thickness of the stacked dielectric material is determined according to the desired lower resonant frequency of the antenna structure. The effective dielectric constant ($\in_{eff}$) of a two stacked dielectric layers may be estimated using a double layer parallel plate capacitor model (Equation 1) where ($\in_1$, $h_1$), ($\in_2$, $h_2$) are the dielectric constant and thickness of top and bottom dielectric layers, respectively.

$$\varepsilon_{eff} \approx \frac{\varepsilon_1 \varepsilon_2 (h_1 + h_2)}{\varepsilon_1 \cdot h_2 + \varepsilon_2 \cdot h_1} \qquad \text{Equation 1}$$

The resonant frequency of the lowest mode may then be estimated from Equation 2, using the estimated $\in_{eff}$ from Equation 1 and the chosen diameter (D).

$$f_0 \approx \frac{1.84}{\pi D \sqrt{\mu \varepsilon_{eff}}} \qquad \text{Equation 2}$$

If the top dielectric layer is fabricated from thermoset microwave laminate material as disclosed above then, in practice, the dielectric constant and thickness ($\in_1$, $h_1$) of the top dielectric layer may be determined based on available printed circuit board materials. Therefore, the characteristics of the ceramic puck material used to form the bottom dielectric layer may be used to produce a patch mode resonance that is close to the desired lower frequency band. The bandwidth requirement of the application to which the antenna structure will be applied may be used to determine the total thickness ($h_1$+$h_2$) of the stacked dielectric layers.

Figure 3:
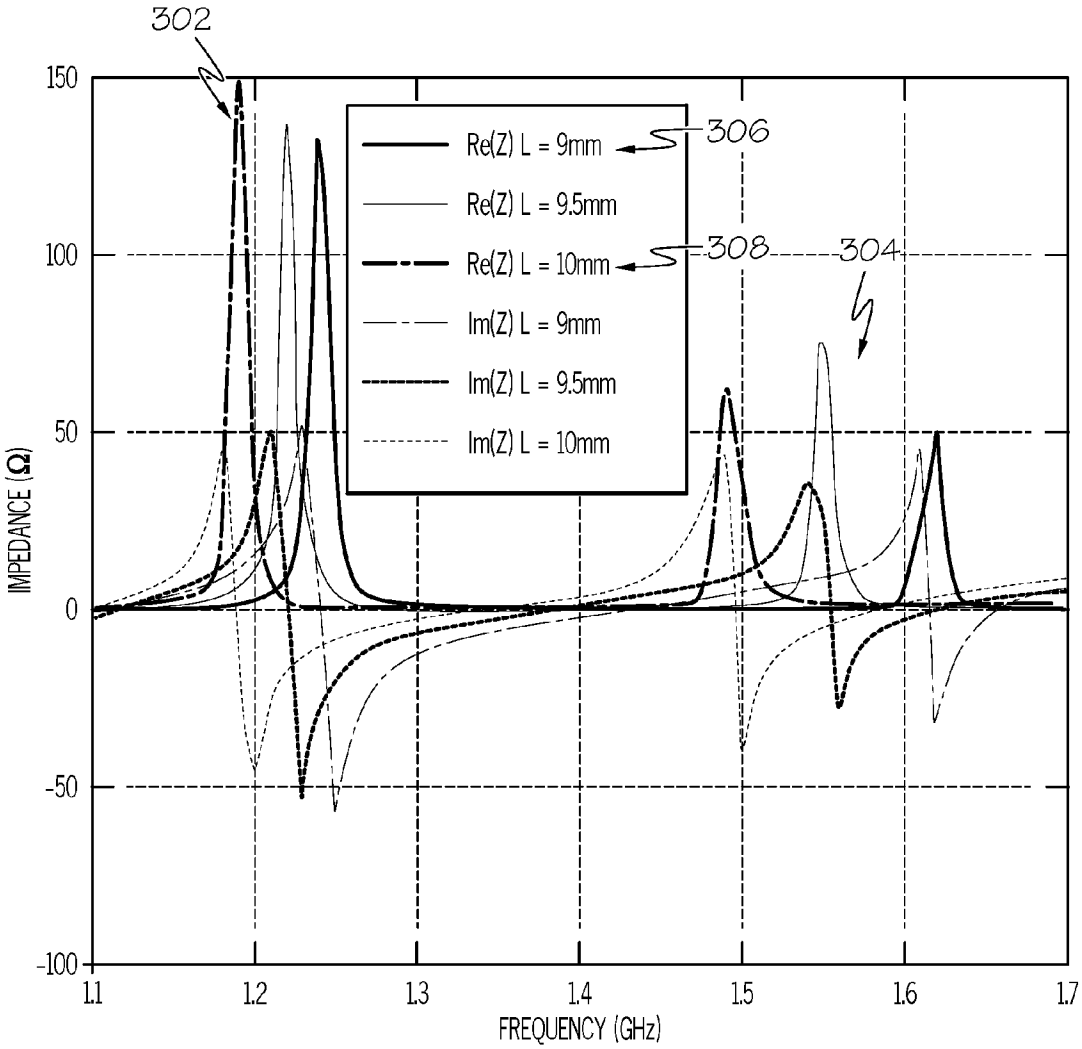
FIG. 3 is a graph of calculated impedance with respect to frequency for an exemplary embodiment.
Figure 4:
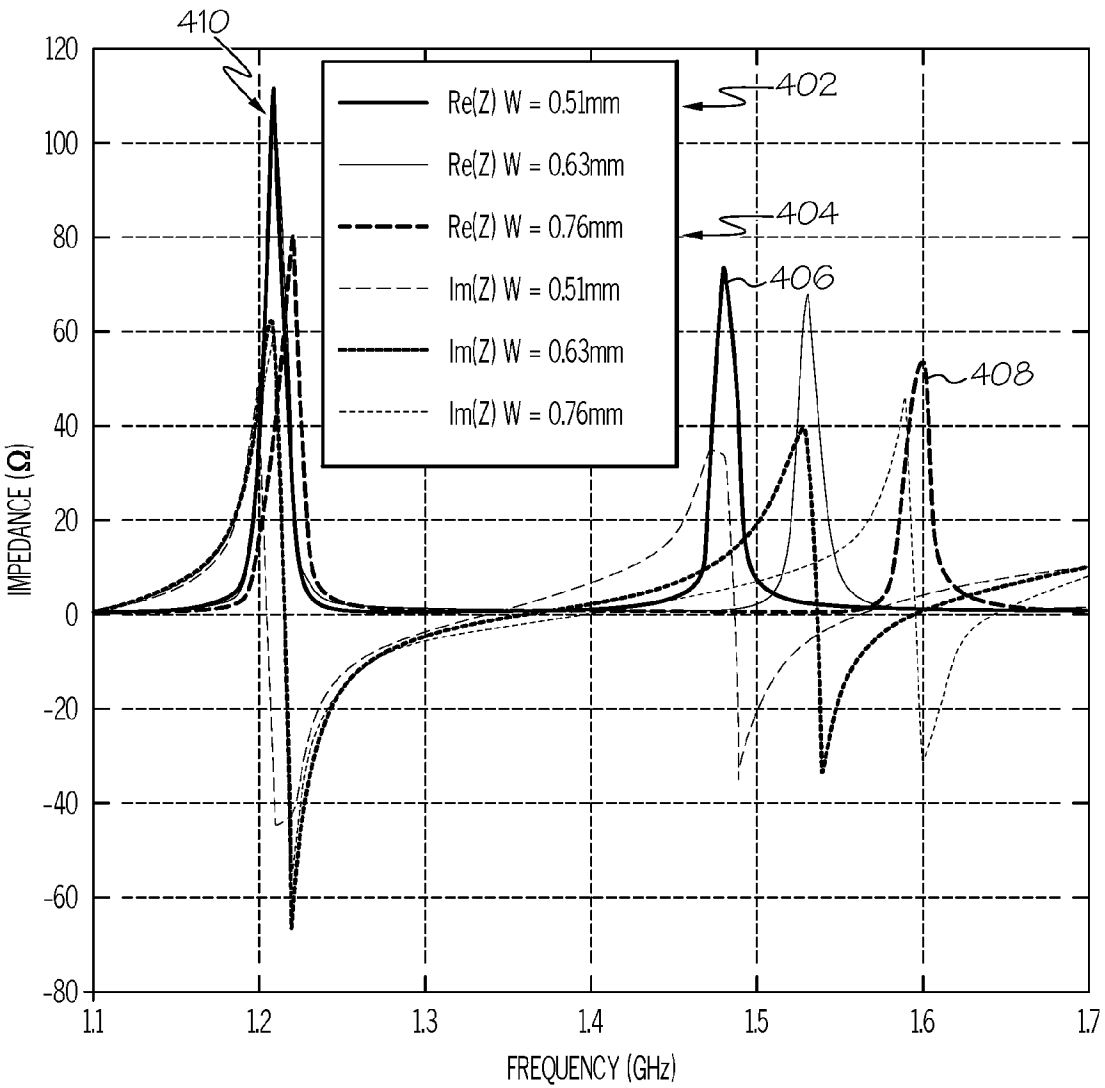
FIG. 4 is a graph of calculated impedance with respect to frequency for an exemplary embodiment.

The second step is to determine the length (L) and width (W) of the meandering slots. The length is shown as 108 and the width as 110 in FIG. 1*a*. These dimensions may be used to tune the resonant frequency of the lower mode. As is illustrated in FIG. 3, the input impendence of an exemplary embodiment of an antenna structure is lowered as the meandering slot length 108 is increased. For example, the peak values at 302 and 304 represent calculated resonant frequency points, and increasing the slot length from 9 mm 306 to 10 mm 308 may result in a calculated lowering of both the low frequency 302 and high frequency 304 resonance points. FIG. 4 is a simulation of the change in resonant frequency as a factor of slot width. As is illustrated in the example of FIG. 4, changing the slot width from 0.51 mm 402 to 0.76 mm 404 results in a shift in the higher resonant frequency from 1.48 GHz 406 to 1.6 GHz 408 but only a slight shift in the lower resonant frequency 410.

The third step is to adjust the length of the inner tuning stubs, the outlines of which are defined by the conductive material. One such tuning stub is shown at 112 in FIG. 1*a*. In this example, the tuning stubs 112 extend (i.e., radiate) outward from the center hole of the patch, which is circular in an exemplary embodiment. Such as shown in the example of FIG. 1*a*, each of the tuning stubs 112 may extend adjacent to and/or within a proximal portion of a respective meandering slot. Other design configurations may be made in accordance with these specifications to achieve the advantages cited herein.

Figure 5:
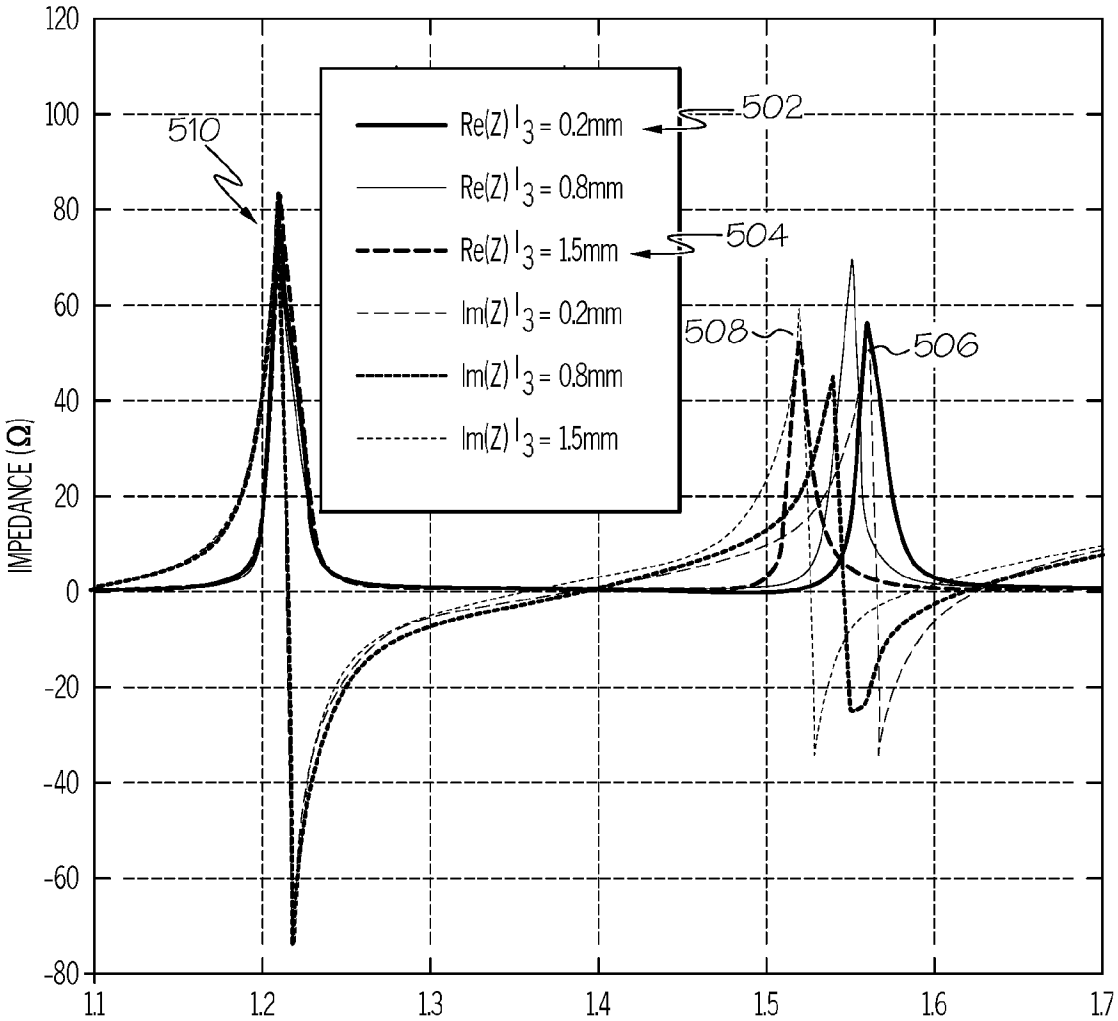
FIG. 5 is a graph of calculated impedance with respect to frequency for an exemplary embodiment.

In an exemplary embodiment, a tuning slot stub may be adapted to be used for fine tuning a resonant frequency of L1 mode without affecting L2 mode. FIG. 5 illustrates the change in input impedance as the inner tuning stub length is varied in an exemplary embodiment. As is illustrated, a change in stub length from 0.2 mm 502 to 1.5 mm 504 may shift the higher resonant frequency from 1.57 GHz 506 to 1.51 GHz 508 without a significant change to the lower resonant mode 510.

An embodiment of the antenna device using the calculations and steps described above and illustrated in FIGS. 1*a* and 1*b* may utilize a 90 degree phase shift between a first and second input to the antenna structure 100. A shift of 90 degrees from a first feed 114 to a second feed 116 may be used to provide signal input to the antenna structure disclosed above. One method of achieving such a shift may be through the use of a commercially available 0-90 degree chip hybrid coupler. FIGS. 2*a* and 2*b* illustrate an example of an antenna structure mounted on a printed circuit board and placed in electrical communication with a hybrid coupler 204. A printed circuit board material (e.g., FR4 grade) is illustrated at 206. In an exemplary embodiment, the antenna structure 100 may be placed into a tightly-fit circular opening formed in the printed circuit board material. Two microstrip lines of equal length 208 are formed by a conductive layer on the top surface of the printed circuit board and may have a characteristic impedance of 50 ohms. The lines 208 may be connected to the outputs of a 0-90 degree chip hybrid coupler 204. A conductive layer 210 laminated to the printed circuit board may serve as a ground plane for the antenna structure 100 and chip hybrid coupler 204.

In one example of performance, the measured reflection coefficient was less than −20 dB from 1.1 GHz to 1.7 GHz and the transmission coefficient was approximately −3.2 dB, very close to a desired −3 dB from a half power divider, within the frequency range of interest. In this example, the measured phase difference between the two output ports varied monotonically from 88° at 1.227 GHz to 90° at 1.575 GHz, which was suitable for CP operation.

In an exemplary embodiment, when the disclosed design steps are performed to design an embodiment of the invention optimized to operate at the GPS L1 and L2 bands using Rogers TMM10i board ($h_1$=1.27 mm, $\in_r$=9.8, tan δ=0.002) as the upper dielectric layer and a high dielectric ceramic puck ($h_2$=10 mm, $\in_r$=45, tan δ≈0.0001) as the lower dielectric layer, the resultant design parameters are as summarized in Table 1.

TABLE 1

| Parameters | Value (mm) | Parameters | Value (mm) |
|---|---|---|---|
| L | 9.52 | $r_1$ | 2.5 |
| W | 0.58 | $h_1$ | 1.27 |
| $l_1$ | 2.29 | $h_2$ | 10 |
| $l_2$ | 0.61 | $h_3$ | 9.8 |
| $l_3$ | 1.02 | | |

Figure 6:
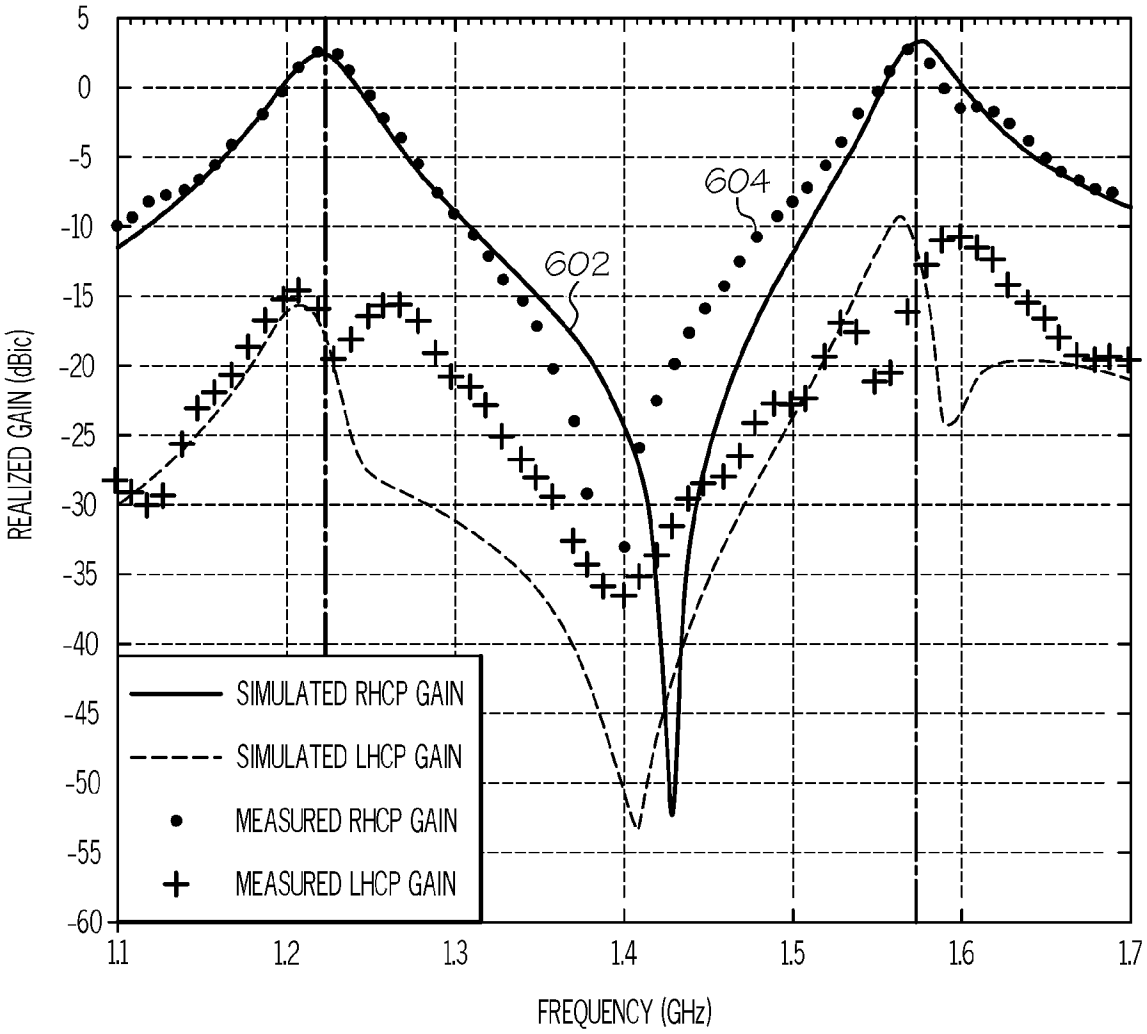
FIG. 6 is a graph of realized gain with respect to frequency for an exemplary embodiment.

Other parameters may be obtained with the choice a different dielectric substrate. As is illustrated in FIG. 6, the simulated RHCP gain 602 of an exemplary embodiment is very close to the measured gain 604 of an antenna device constructed according to the parameters in Table 1. In this example, the RHCP antenna gain is around 3.2 dBi at 1.227 GHz and 3.5 dBi at 1.575 GHz. The RHCP to LHCP isolation is 20 dB at L2 band and 15 dB at L1 band. The axial ratio of this exemplary embodiment is 1.3 dB at 1.227 GHz and 1.9 dB at 1.575 GHz, and the 3-dB bandwidth of lower mode is 45 MHz from 1200 MHz to 1245 MHz and high mode is 50 MHz from 1545 MHz to 1595 MHz at zenith. Such bandwidths are sufficient to support modern coding schemes such as P/Y and M code.

In an exemplary embodiment, the resonant field distribution may occupy substantially the entire substrate in L2 (1227 MHz) mode and be mostly concentrated around the meandered slots in L1 (1575 MHz) mode. The meandered slots, the center circular hole of the patch, and the high dielectric substrate may help to establish L2 mode resonance within a physically small antenna volume. The concentration of fields only around slots in L1 band may also make it possible to tune the L1 frequency independently by adjusting the length $l_3$ of the inner tuning slot stubs.

Figure 7B:
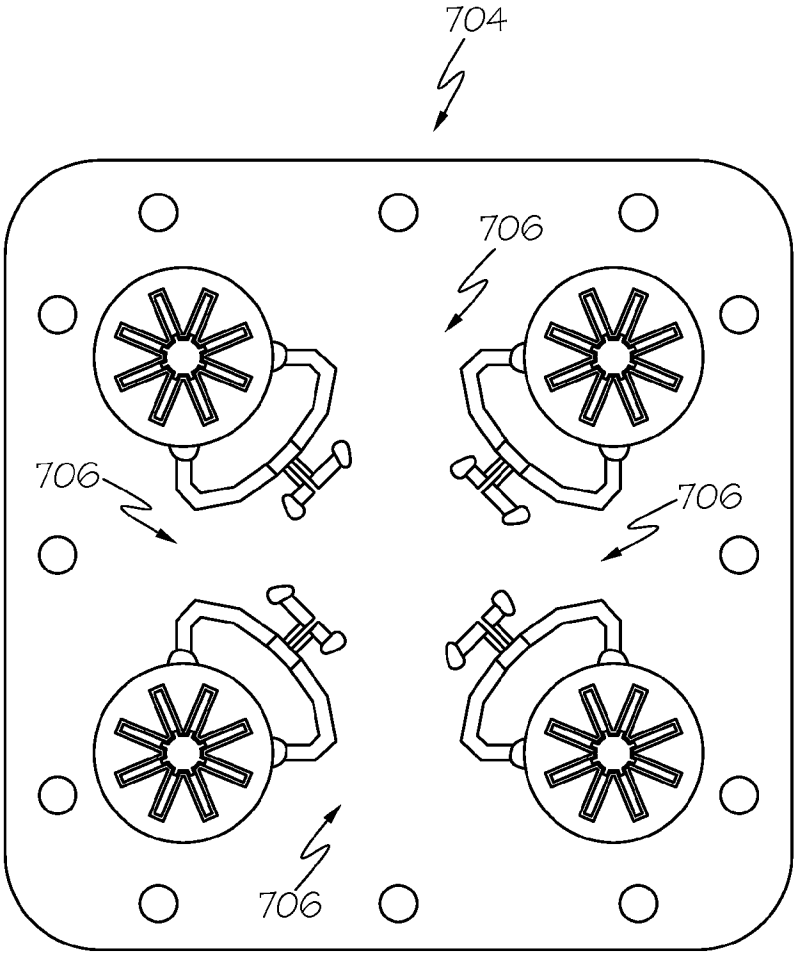
FIGS. 7*a* and 7*b* are top plan view illustrations of exemplary embodiments of the invention.
Figure 7A:
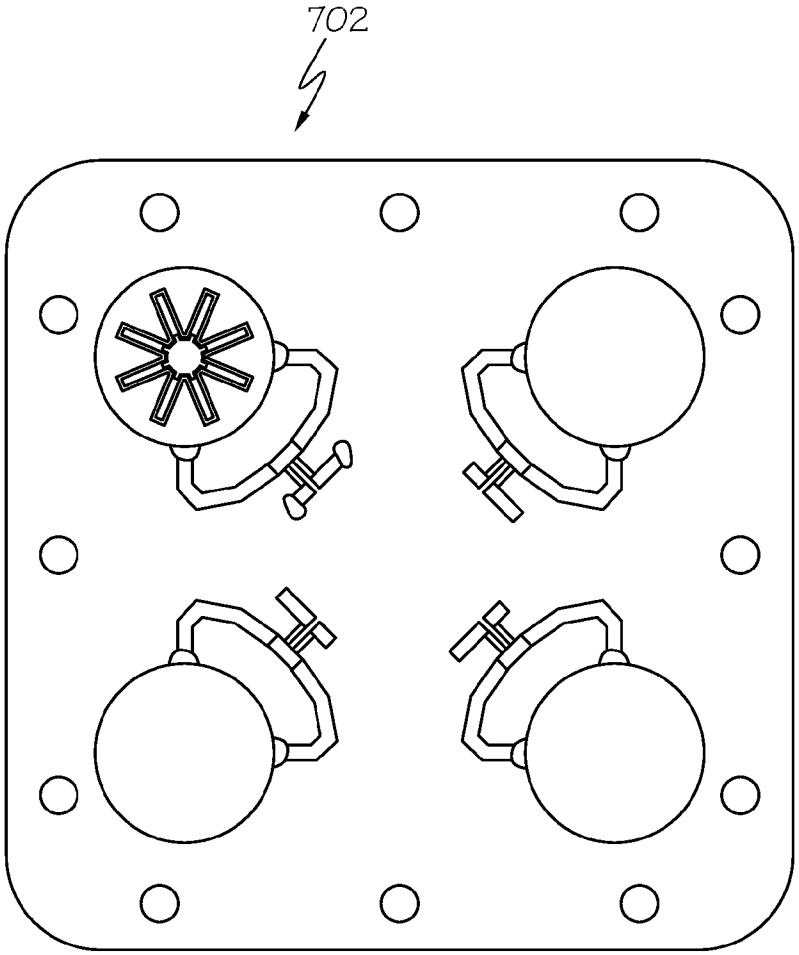
Figure 8A:
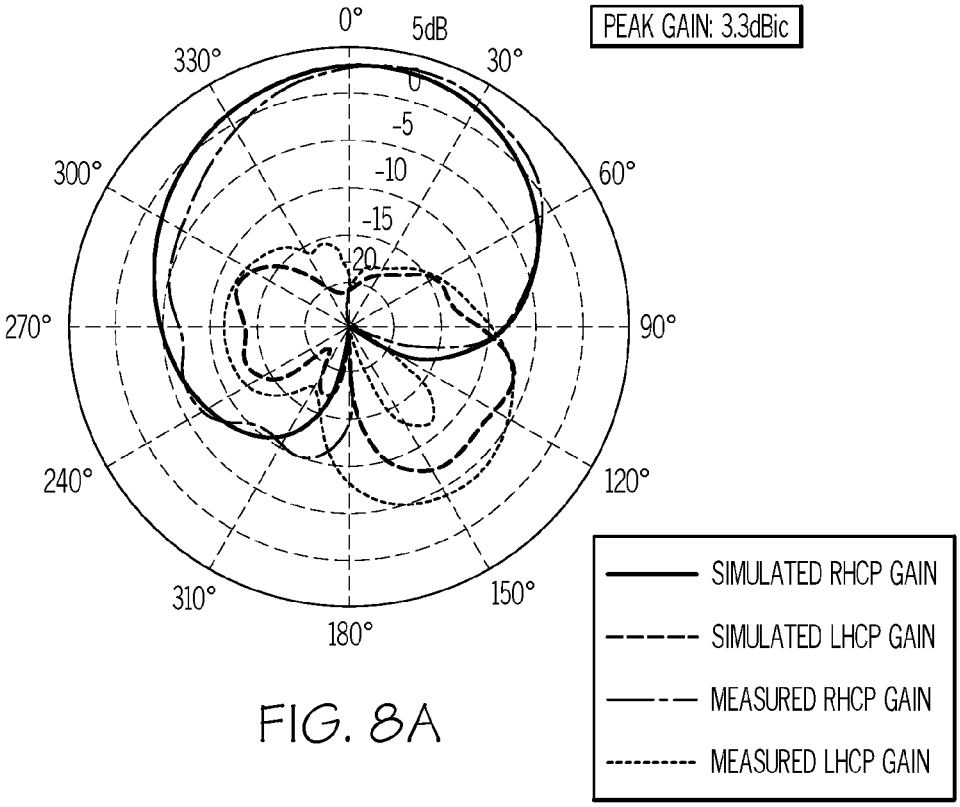
FIGS. 8*a*-8*d* are graphs of peak gains of the embodiments of FIGS. 7*a* and 7*b*.
Figure 8B:
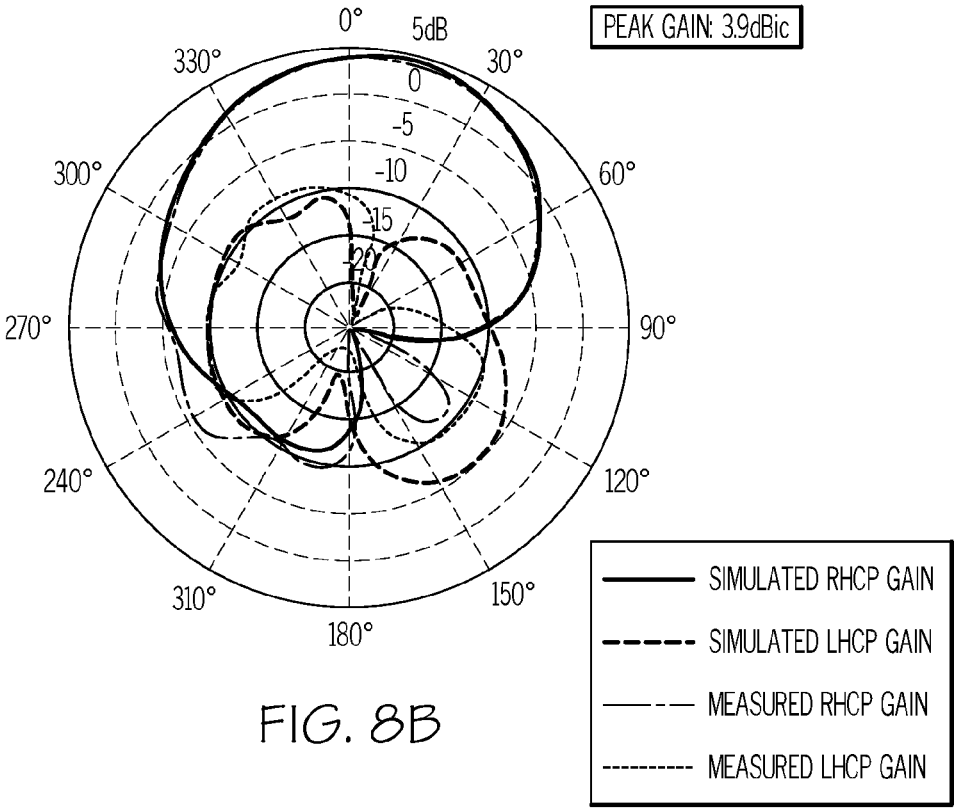
Figure 8C:
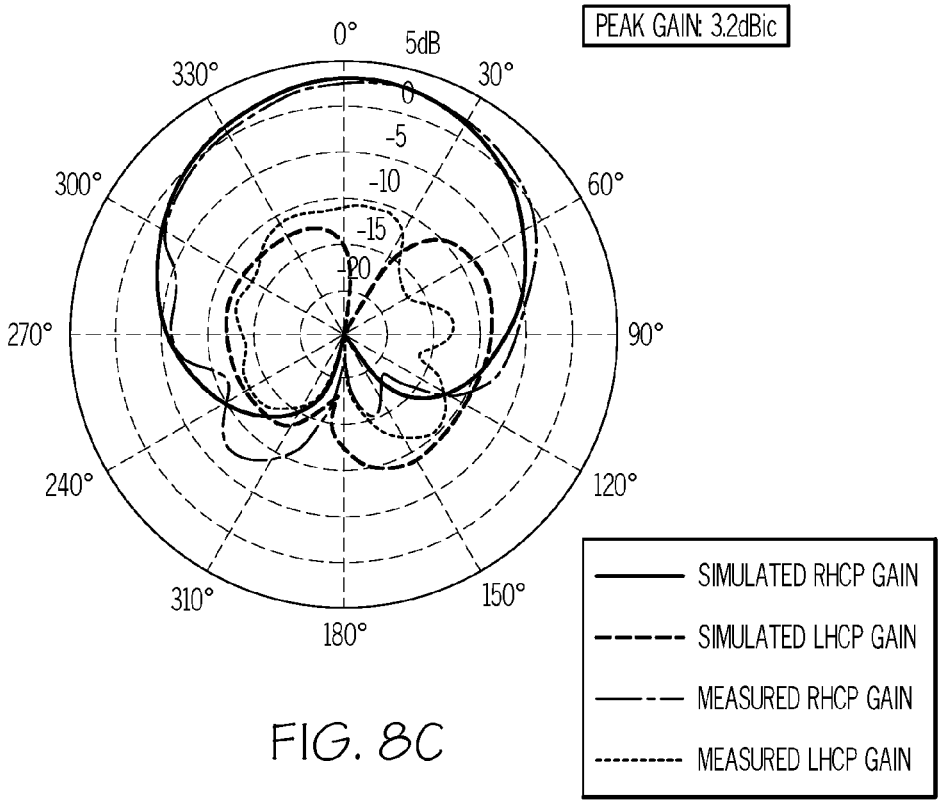
Figure 8D:
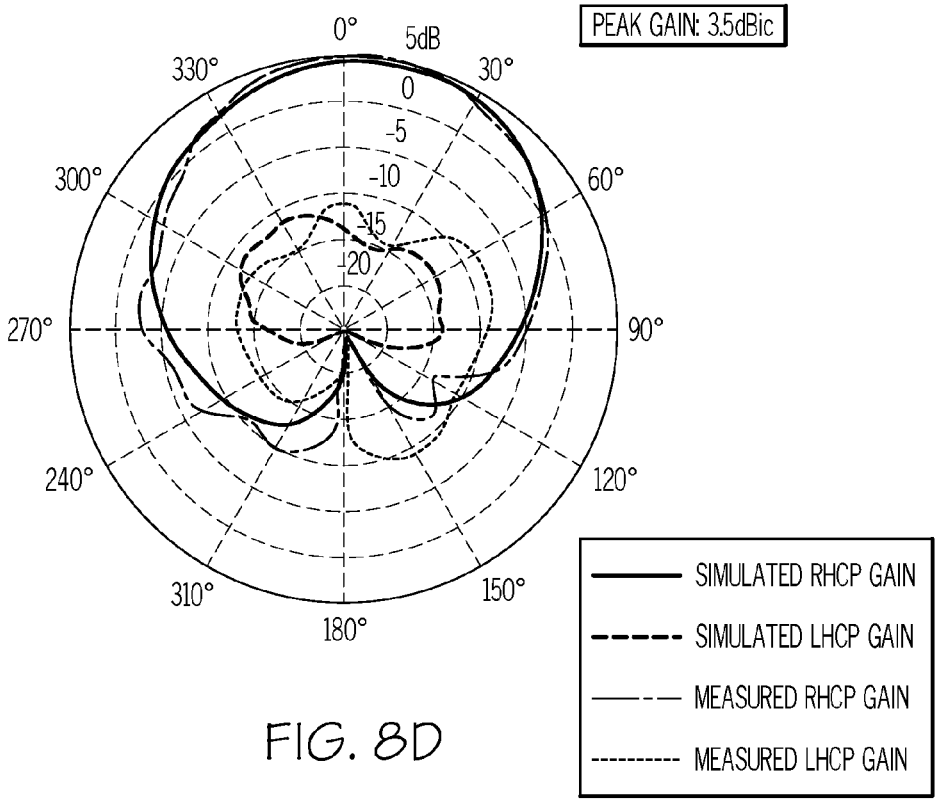

A known difficulty with closely space antenna array elements is the impact that such an array may have on the impedance matching, resonant frequency, and radiation pattern of elements of the array. Exemplary embodiments of the invention have been found to exhibit minimal impact when arranged in a compact array configuration (e.g., a compact 4-element array configuration). FIG. 7*a* illustrates a single antenna element 702, and FIG. 7*b* illustrates a multiple antenna element 704 configuration with a spacing 706 of 62.5 mm between adjacent antenna elements. Signals were introduced to the single element 702 and multiple element 704 configurations at center frequencies of the GPS L1 and L2 bands. As is illustrated in the elevation patterns of FIGS. 8*a*, 8*b*, 8*c*, and 8*d*, operating a single element in a multiple element configuration 704 with the remaining three elements terminated with 50 ohm loads (FIGS. 8*a* and 8*b*) provides a similar sky coverage and broadside gain result to that of a single element configuration 702 (FIGS. 8*c* and 8*d*). As is illustrated, the maximum gain level for the multiple element configuration 704 is 3.3 dBi at the L2 band and 3.9 dBi at the L1 band for this exemplary embodiment. These gain levels are similar to the single element gain illustrated in the example of FIGS. 8*c* and 8*d*.

In one example, an embodiment of an array configuration was designed for operation at 1.227 GHz with 45 MHz 3-dB bandwidth and 1.575 GHz with 50 MHz 3-dB bandwidth at zenith. Such an example may be miniaturized down to 25.4 mm in diameter without the feeding network and approximately 25.4 mm by 40.6 mm with the feeding network. Simulation of such an example has resulted in an indication that 90% radiation efficiency may be achieved using low loss dielectric material. In another exemplary embodiment, RHCP feeding circuitry may be implemented using a small 0°-90° hybrid chip that provides desired power splitting and stable quadrature phase difference at its two outputs. The measured gain and pattern data of such an embodiment validated the simulated performance and showed wide RHCP sky coverage and more than 15 dB of RHCP to left hand circular polarization (LHCP) isolation at both L1 and L2 bands. Other embodiments are possible based on the teaching provided herein. For example, some embodiments may have a diameter less than about 25.4 mm (i.e., 1 inch) and/or a height less than about 11.27 mm. Other embodiments may have greater dimensions.

Such as described, exemplary embodiments may employ a low-loss, high-dielectric substrate and the meandered-slot designs to increase the antenna's electrical size. An example of the design may also adopt external proximity probes. In an exemplary embodiment, the patch mode and the slot mode may share the probe(s). The combination of the above features greatly improves manufacturability and reliability. In addition, an example of the design may utilize a small 0°-90° hybrid chip (e.g., Mini-circuit QCN-19) to reduce the size of feeding network and achieve good RHCP performance over a wider frequency range. In one example, the antenna may be adapted to provide RHCP by combining two orthogonal modes via the hybrid chip. As a further example, the antenna design may be applied in an array (e.g., 4 elements) without suffering performance degradation due to mutual coupling. For example, in one such an embodiment, the antennas may have separate connectors such that one can combine received signals (digitally in post processing) using different algorithms to improve received signal quality and/or to suppress interference.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. An antenna comprising:

a dielectric substrate layer;

a patch layer comprising a conductive patch, said patch layer on top of said substrate layer;

a 0°-90° hybrid chip;

a proximity probe located on an external side of said antenna such that said proximity probe is not in contact with said conductive patch of said patch layer; and at least one additional external proximity probe located on said external side of said antenna such that said at least one additional proximity probe is not in contact with said conductive patch of said patch layer;

wherein each said probe is vertical, comprised of conductive material, and in communication with said hybrid chip; and wherein said antenna is adapted to provide dual band coverage with a patch mode and a slot mode via said proximity probe.

2. The antenna of claim 1 wherein said antenna has a diameter of about 25.4 mm.

3. The antenna of claim 1 wherein said antenna has a diameter less than about one inch.

4. The antenna of claim 1 wherein said antenna has height of about 11.27 mm.

5. The antenna of claim 1 wherein said patch layer has a height of about 1.27 mm.

6. The antenna of claim 1 wherein said dielectric substrate layer has a height of about 10 mm.

7. The antenna of claim 1 wherein said antenna has a dimension of about $\lambda/10$ at an L2 band.

8. The antenna of claim 1 wherein said antenna is adapted to provide said patch mode at an L2 band and said slot mode at an L1 band.

9. The antenna of claim 1 wherein said patch layer is comprised of PCB.

10. The antenna of claim 9 wherein said patch layer further comprises a meandering slot defined by said conductive patch on top of said PCB.

11. The antenna of claim 10 wherein said conductive patch further defines a circular hole such that said dielectric substrate, said meandering slot, and said circular hole are adapted to facilitate an L2 mode resonance.

12. The antenna of claim 10 wherein resonant field distribution is adapted to occupy substantially the entire dielectric substrate in an L2 mode and be mostly concentrated around the meandered slot in an L1 mode.

13. The antenna of claim 10 further comprising a tuning slot stub extending within said meandering slot and adapted to be used for fine tuning a resonant frequency of an L1 mode without affecting an L2 mode.

14. The antenna of claim 1 wherein said dielectric substrate layer has a dielectric constant of about 45.

15. The antenna of claim 1 wherein said dielectric substrate layer is adhered to said patch layer by a dielectric paste.

16. The antenna of claim 1 wherein said antenna is adapted to provide sufficient bandwidth for an L1 band and an L2 band with RHCP and LHCP isolation of greater than about 15 dB.

17. The antenna of claim 1 wherein each said additional proximity probe is adapted to provide said patch mode and said slot mode.

18. The antenna of claim 1 wherein said antenna is adapted to provide RHCP by combining two orthogonal modes via said hybrid chip.

19. An antenna system comprising:

a plurality of antennas, each said antenna comprising:

a dielectric substrate layer;

a patch layer comprising a conductive patch, said patch layer on top of said substrate layer; and a plurality of proximity probes located on an external side of said antenna such that each said proximity probe is not in contact with said conductive patch of said patch layer; and a 90° hybrid coupler in communication with at least one of said antennas;

wherein each said probe is vertical, comprised of conductive material, and in communication with said hybrid coupler; and wherein said antenna is adapted to provide dual band coverage with a patch mode and a slot mode via each said proximity probe.

20. The antenna system of claim 19 comprising four said antennas.

21. The antenna system of claim 19 wherein said antenna system is adapted to provide a reflection coefficient less than about −20 dB and a transmission coefficient of about −3.2 dB at a predetermined frequency.

22. The antenna system of claim 19 wherein said antenna system is adapted to provide a phase difference of about 90° in both L1 and L2 bands.

* * * * *